US007607759B2

(12) United States Patent
Min et al.

(10) Patent No.: US 7,607,759 B2
(45) Date of Patent: Oct. 27, 2009

(54) INKJET PRINTHEAD AND METHOD OF MANUFACTURING THE SAME

(75) Inventors: Jae-sik Min, Suwon-si (KR); Byung-ha Park, Suwon-si (KR); Kyong-il Kim, Seoul (KR); Young-ung Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 420 days.

(21) Appl. No.: 11/379,291

(22) Filed: Apr. 19, 2006

(65) Prior Publication Data

US 2007/0046732 A1 Mar. 1, 2007

(30) Foreign Application Priority Data

Aug. 27, 2005 (KR) ..... 10-2005-0079130

(51) Int. Cl.
*B41J 2/05* (2006.01)

(52) U.S. Cl. ..... 347/63

(58) Field of Classification Search ..... 347/61–63
See application file for complete search history.

(56) References Cited

U.S. PATENT DOCUMENTS 6,019,457 A * 2/2000 Silverbrook ..... 347/65
6,070,969 A * 6/2000 Buonanno ..... 347/64
6,595,627 B2 * 7/2003 Min et al. ..... 347/65
6,663,226 B2 * 12/2003 Min et al. ..... 347/58

FOREIGN PATENT DOCUMENTS

| | | |
|---|---|---|
| JP | 59-1526 | 1/1984 |
| JP | 2001-191532 | 7/2001 |
| JP | 2003-191472 | 7/2003 |
| JP | 2004-122770 | 4/2004 |
| KR | 2003-27003 | 4/2003 |
| KR | 2004-54036 | 6/2004 |
| KR | 2004-70431 | 8/2004 |

* cited by examiner

*Primary Examiner*—An H Do
(74) *Attorney, Agent, or Firm*—Stanzione & Kim LLP

(57) ABSTRACT

An inkjet printhead and a method of manufacturing the same. In the inkjet printhead, a substrate includes an ink chamber formed in a top surface to contain ink to be ejected, an ink feedhole formed in a bottom surface to supply the ink to the ink chamber, and a restrictor formed between the ink chamber and the ink feedhole to connect the ink chamber and the ink feedhole. A plurality of passivation layers are formed on the substrate. A heater and a conductor to apply a current to the heater are formed between the passivation layers. A heat transfer layer is formed on the passivation layers in a predetermined shape. An epoxy nozzle layer is formed to cover the passivation layers and the heat transfer layer. The epoxy nozzle layer is formed with a nozzle that is connected to the ink chamber.

20 Claims, 9 Drawing Sheets

INKJET PRINTHEAD AND METHOD OF MANUFACTURING THE SAME

CROSS-REFERENCE TO RELATED APPLICATIONS

This application claims the benefit under 35 U.S.C. § 119 of Korean Patent Application No. 10-2005-79130, filed on Aug. 27, 2005, in the Korean Intellectual Property Office, the disclosure of which is incorporated herein in its entirety.

BACKGROUND OF THE INVENTION

1. Field of the Invention

The present general inventive concept relates to an inkjet printhead and a method of manufacturing the inkjet printhead, and more particularly, to a back-shooting type inkjet printhead that effectively dissipates heat generated from a heater to improve ink ejection characteristics, and a method of manufacturing the back-shooting type inkjet printhead.

2. Description of the Related Art

Generally, an inkjet printhead is a device for printing a color image on a printing medium by firing droplets of ink onto a desired region of the printing medium. There is a shuttle type inkjet printer and a line printing type inkjet printer. The shuttle type inkjet printer has an inkjet printhead that prints an image while the printhead moves in a direction perpendicular to the feeding direction of the printing medium. The line printing type inkjet printer is a recently developed high speed printer that has an array printhead having a width corresponding to the width of the printing medium. The array printhead includes a plurality of inkjet printheads that are arranged in a predetermined pattern. In the line printing type inkjet printer, the array printhead is fixed and the printing medium is fed past the array printhead for printing, so that high speed printing can be realized.

The inkjet printhead can be classified into two types according to the ejecting mechanism of the droplets of ink. The thermal type inkjet printhead creates bubbles with heat to eject the droplets of ink by the expansion of the bubbles, and the piezoelectric type inkjet printhead includes a piezoelectric material to eject the droplets of ink by utilizing pressure generated by the deformation of the piezoelectric material.

The ink droplet ejecting mechanism of the thermal printhead will now be more fully described. When a pulse current is applied to a heater formed of a resistive heating material, heat is generated from the heater to immediately increase the temperature of adjacent ink to about 300° C. As a result, bubbles are created, and the bubbles exert pressure on the ink filled in an ink chamber as the bubbles expand. The pressure pushes the ink out of the ink chamber through a nozzle in the form of droplets.

The thermal type inkjet printheads can be divided into three types depending on the growing direction of the bubbles and the ejecting direction of the droplets of ink. The three types of the thermal inkjet printheads are a top-shooting type inkjet printhead, a side-shooting type inkjet printhead, and a back-shooting type inkjet printhead. The growing direction of the bubbles and the ejecting direction of the droplets of ink are the same in the top-shooting type inkjet printhead, perpendicular to each other in the side-shooting type inkjet printhead, and opposite to each other in the back-shooting type inkjet printhead.

FIG. 1 is a side sectional view illustrating a conventional inkjet printhead disclosed in U.S. Pat. No. 5,841,452, as an example of a conventional back-shooting type inkjet printhead.

Referring to FIG. 1, an ink chamber 15 is formed in an upper portion of a substrate 10 to contain ink to be ejected, and an ink feedhole 17 is formed in a lower portion of the substrate 10 to supply ink to the ink chamber 15. Between the ink chamber 15 and the ink feedhole 17, a restrictor 13 is formed in a direction perpendicular to the surface of the substrate 10 to connect the ink chamber 15 and the ink feedhole 17. A nozzle plate 20 is stacked on the substrate 10, and the nozzle plate 20 is formed with a nozzle 21 to eject an ink droplet 30. The nozzle plate 20 includes a silicon oxide layer 23 formed on a surface of the substrate 10, heaters 22 formed on the silicon oxide layer 23 around the nozzle 21, and a passivation layer 25 protecting the heaters 22. In the passivation layer 25, thermal shunts 24 are provided to dissipate heat accumulated around the heater 22 toward the substrate 10 after the ink is ejected.

However, in the conventional inkjet printhead, heat remaining after the ink is ejected by the heater 22 is dissipated toward the substrate 10 through the silicon oxide layer 23, which has a low thermal conductivity. Therefore, a large amount of heat is accumulated in the nozzle plate 20 after the ink is ejected. The accumulated heat increases the temperature of the ink in the ink chamber 15, thereby changing the viscosity of the ink and deteriorating ejection characteristics of the ink.

Furthermore, the line printing type inkjet printers have been recently developed to satisfy the demand for high integration of the inkjet printhead and high speed printing. Such a line printing type inkjet printer generally employs the array printhead having the plurality of inkjet printheads. Since the array printhead is provided with a plurality of heaters, heat generated from the heaters and accumulated around the heaters is considerably large. Therefore, if the above-described conventional inkjet printheads are used for the array printhead, the ink-ejection characteristics of the array printhead are deteriorated much more.

SUMMARY OF THE INVENTION

The present general inventive concept provides a back-shooting type inkjet printhead that improves ink ejecting characteristics by effectively dissipating heat generated from a heater, and a method of manufacturing the back-shooting type inkjet printhead.

Additional aspects and utilities of the present general inventive concept will be set forth in part in the description which follows and, in part, will be obvious from the description, or may be learned by practice of the general inventive concept.

The foregoing and/or other aspects of the present general inventive concept are achieved by providing an inkjet printhead including a substrate including an ink chamber formed in a top surface thereof to contain ink to be ejected, an ink feedhole formed in a bottom surface thereof to supply the ink to the ink chamber, and a restrictor formed between the ink chamber and the ink feedhole to connect the ink chamber and the ink feedhole, a plurality of passivation layers formed on the substrate, a heater and a conductor that are formed between the passivation layers, the heater disposed above the ink chamber and the conductor applying a current to the heater, a heat transfer layer formed on the passivation layers in a predetermined shape, and an epoxy nozzle layer formed to cover the passivation layers and the heat transfer layer, the epoxy nozzle layer being formed with a nozzle connected to the ink chamber.

The passivation layers may define a thermal plug therethrough to expose the top surface of the substrate, and the heat transfer layer may contact the substrate through the thermal plug.

The passivation layers may define a nozzle via hole therethrough in alignment with the nozzle, and the epoxy nozzle layer may be formed to cover an inner wall of the nozzle via hole.

The heat transfer layer may be formed on an entire top surface of the passivation layers, or the heat transfer layer may be formed on a top surface of the passivation layers in a region located a predetermined distance from a side of the heater.

The heat transfer layer may be formed of silver (Ag), and the heat transfer layer may have a thickness of 5 μm or more.

The epoxy nozzle layer may be formed of a photosensitive epoxy, and the epoxy nozzle layer may have a thickness of 20 μm to 30 μm.

The passivation layers may include a first passivation layer and a second passivation layer that are sequentially stacked on the substrate, the heater may be formed between the first and second passivation layers, and the conductor may be formed between the heater and the second passivation layer. The first and second passivation layers may be formed of silicon oxide or silicon nitride.

The restrictor may be formed on the same plane as the ink chamber. The ink chamber and the restrictor may include inner walls formed with oxide layers.

The nozzle may have a taper shaped side section that becomes narrower toward an exit end of the nozzle.

The foregoing and/or other aspects of the present general inventive concept are also achieved by providing an inkjet printhead including a substrate having an ink chamber to contain ink, a heater to heat the ink contained in the ink chamber, one or more passivation layers adjacent to the heater to protect the heater, and a heat transfer layer to contact a portion of the one or more passivation layers and a surface of the substrate to dissipate heat generated by the heater from the one or more passivation layers to the substrate.

The foregoing and/or other aspects of the present general inventive concept are also achieved by providing an inkjet printhead including a substrate having an ink chamber to store ink, a heater to heat the ink in the ink chamber, a nozzle layer having nozzles to eject droplets of the ink from the ink chamber due to heat generated by the heater, one or more passivation layers to separate the heater from the substrate and the nozzle layer, and formed with a thermal plug to expose a surface of the substrate therethrough, and a heat transfer layer formed between the one or more passivation layers and the nozzle layer and in the thermal plug to prevent the heat generated by the heater from accumulating in the nozzle layer by dissipating the heat to the surface of the substrate.

The foregoing and/or other aspects of the present general inventive concept are also achieved by providing a method of manufacturing an inkjet printhead, the method including forming a trench in a top surface of a substrate to define an ink chamber and a restrictor, and forming an oxide layer on the top surface of the substrate including an inner wall of the trench, filling the trench with a sacrifice layer formed of a predetermine material, stacking passivation layers on the substrate and the sacrifice layer, and forming a heater and a conductor between the passivation layers, patterning the passivation layers to form a nozzle via hole exposing a top surface of the sacrifice layer and a thermal plug exposing the top surface of the substrate, forming a heat transfer layer on the passivation layers to a predetermined thickness to fill the thermal plug, forming an epoxy nozzle layer to cover the passivation layers and the heat transfer layer, and defining a nozzle through the epoxy nozzle layer in alignment with the nozzle via hole to expose the top surface of the sacrifice layer, forming an ink feedhole by etching a bottom surface of the substrate to expose the oxide layer formed on a bottom of the trench, forming the ink chamber and the restrictor by removing the sacrifice layer exposed through the nozzle, and removing a portion of the oxide layer that is located between the ink feedhole and the restrictor.

The filling of the trench with the sacrifice layer may include depositing poly silicon on the oxide layer of the substrate using an epitaxial method to fill the trench, and planarizing a top surface of the poly silicon through a CMP (chemical mechanical polishing) process to expose the top surface of the substrate.

The stacking of the passivation layers on the substrate and the sacrifice layer and the forming of the heater and the conductor between the passivation layers may include forming a first passivation layer on the top surfaces of the substrate and the sacrifice layer, forming the heater on a top surface of the first passivation layer and forming the conductor on a top surface of the heater, and forming a second passivation layer on the top surface of the first passivation layer to cover the heater and the conductor.

The forming of the heat transfer layer on the passivation layers may include coating the passivation layers with a photosensitive silver (Ag) paste to a predetermined thickness to fill the nozzle via hole and the thermal plug, and patterning the photosensitive Ag paste through a lithography process.

The forming of the epoxy nozzle layer may include coating the passivation layers and the heat transfer layer with a photosensitive epoxy to fill the nozzle via hole, and forming the nozzle in alignment with the nozzle via hole by patterning the photosensitive epoxy through a lithography process.

The foregoing and/or other aspects of the present general inventive concept are also achieved by providing a method of manufacturing an inkjet printhead, including forming an ink chamber in a substrate, forming a first passivation layer on the substrate and above the ink chamber, forming a heater on the first passivation layer, forming a second passivation layer on the first passivation layer to cover the heater, forming a thermal plug through the first and second passivation layers to expose a surface of the substrate, and forming a heat transfer layer on the second passivation layer and in the thermal plug to dissipate heat from the first and second passivation layer to the surface of the substrate.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
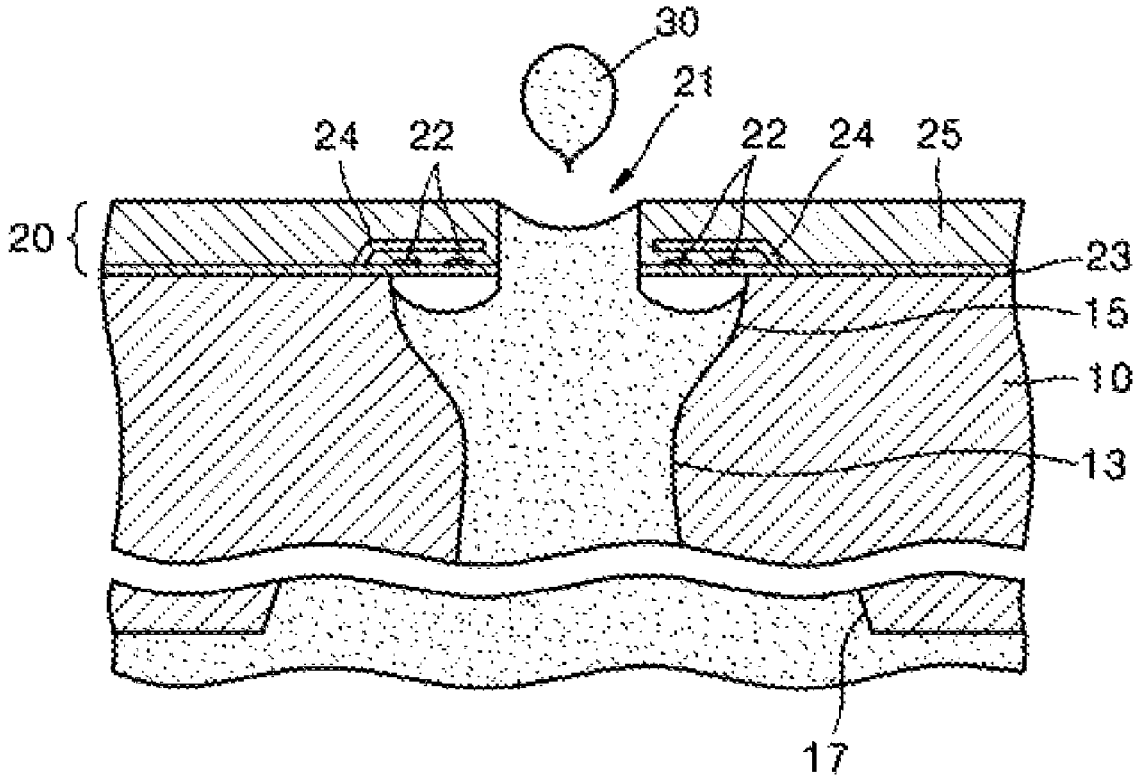
FIG. 1 (PRIOR ART)
FIG. 1 is a side sectional view illustrating an example of a conventional back-shooting type inkjet printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
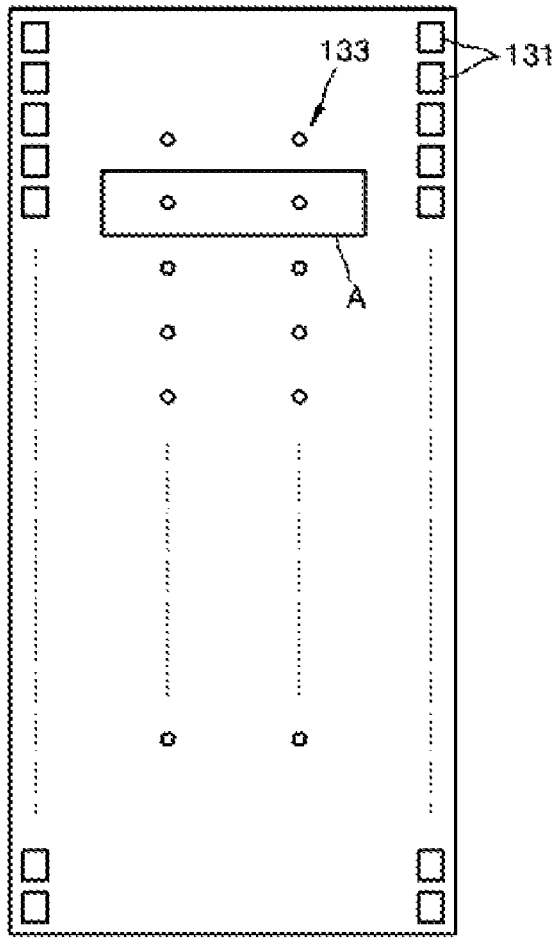
FIG. 2 is a plan view schematically illustrating an inkjet printhead according to an embodiment of the present general inventive concept.

FIG. 2 is a plan view schematically illustrating an inkjet printhead according to an embodiment of the present general inventive concept. Referring to FIG. 2, the inkjet printhead can include ink ejection portions 133 arranged vertically in two rows and bonding pads 131 arranged to electrically connect with the respective ink ejection portions 133. Though the ink ejection portions 133 are arranged in two rows in FIG. 2, the ink ejection portions 133 can be arranged in one row, or in three or more rows to increase resolution of the inkjet printhead.

Figure 3:
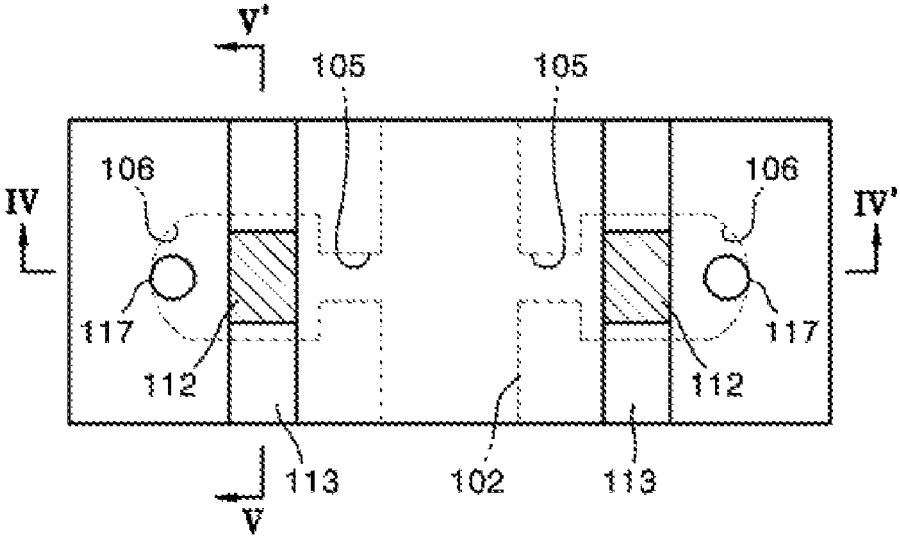
FIG. 3 is an enlarged view illustrating a portion A of the inkjet printhead of FIG. 2.
Figure 4:
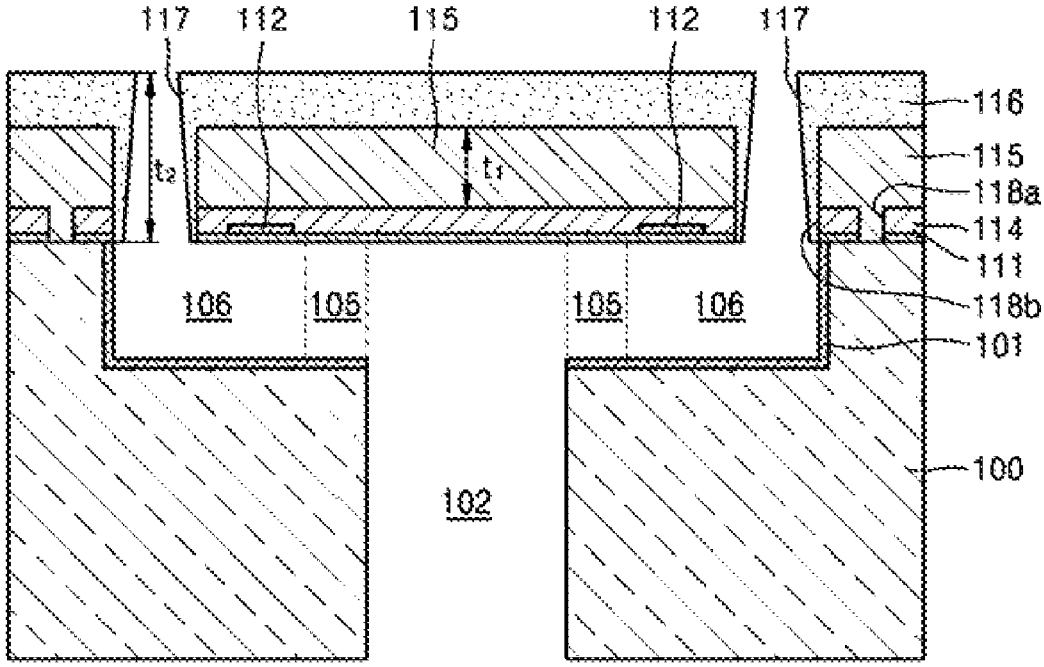
FIG. 4 is a sectional view illustrating the portion A of the inkjet printhead of FIG. 3 taken along a line IV-IV'.
Figure 5:
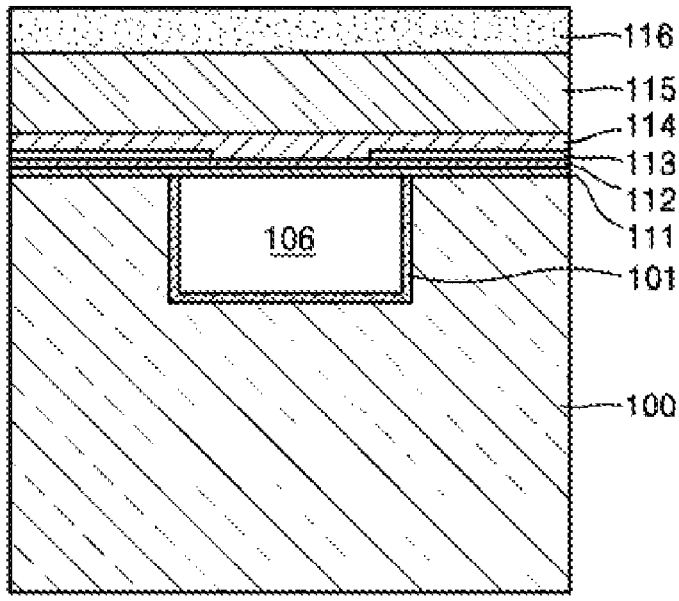
FIG. 5 is a sectional view illustrating the portion A of the inkjet printhead of FIG. 3 taken along a line V-V'.

FIG. 3 is an enlarged view illustrating a portion A of the inkjet printhead of FIG. 2, FIG. 4 is a sectional view taken along a line IV-IV' of FIG. 3, and FIG. 5 is a sectional view taken along a line V-V' of FIG. 3.

Referring to FIGS. 3 through 5, ink chambers 106 are formed in a top surface of a substrate 100 at a predetermined depth to contain ink to be ejected therein, and an ink feedhole 102 is formed in a bottom surface of the substrate 100 to supply the ink to the ink chambers 106. The substrate 100 may be formed of a silicon wafer, but the present general inventive concept is not limited thereto. Restrictors 105 are formed between the ink chambers 106 and the ink feedhole 102 to connect the ink chambers 106 with the ink feedhole 102. The restrictors 105 may be formed parallel to the top surface of the substrate 100 on the same plane as the ink chambers 106. An oxide layer 101 is formed on inner walls of the ink chambers 106 and the restrictor 105. The oxide layer may include a silicon oxide layer.

A plurality of passivation layers 111 and 114 are formed on the substrate 100 in which the ink chambers 106, the restrictors 105, and the ink feedhole 102 are formed. Heaters 112 and conductors 113 are formed between the passivation layers 111 and 114. The heaters 112 heat the ink in the ink chambers 106 to create bubbles, and the conductors 113 apply a current to the heaters 112. A first passivation layer 111 is formed on the substrate 100 to form upper walls of the ink chambers 106. The first passivation layer 111 is a material layer to protect the heaters 112 and to provide insulation between the heaters 112 and the substrate 100. The first passivation layer 111 may be formed of silicon oxide or silicon nitride.

As illustrated in FIGS. 4 and 5, the first passivation layer 111 is formed above the ink chambers 106, and the heaters 112 are formed on the first passivation layer 111. The number of the heaters 112 may correspond to that of the ink chambers 106. Locations and shapes of the heaters 112 may be different from those shown in FIGS. 3-5, according to various embodiments of the present general inventive concept. The heaters 112 may be formed of a resistive heating material, such as tantalum-aluminum alloy, tantalum nitride, titanium nitride, or tungsten silicide. The conductors 113 can be formed on a top surface of the heaters 112 to electrically connect with the heaters 112 to supply the current to the heaters 112. The conductors 113 electrically connect the heaters 112 with the bonding pads 131 (FIG. 1) to supply the current from the bonding pads 131 to the heaters 112. The conductors 113 may be formed of a material having a high electric conductivity, such as for example, aluminum (Al), aluminum alloy, gold (Au), or silver (Ag).

A second passivation layer 114 is formed on a top surface of the first passivation layer 111 to cover the heaters 112 and the conductors 113. The second passivation layer 114 is a material layer to protect the heaters 112 and the conductors 113, and may be formed of silicon oxide or silicon nitride. The first and second passivation layers 111 and 114 define nozzle via holes 118*b* aligned with nozzles 117 (described below). Further, thermal plugs 118*a* are formed through the first and second passivation layers 111 and 114 at opposite sides thereof to expose the substrate 100 therethrough.

Figure 6:
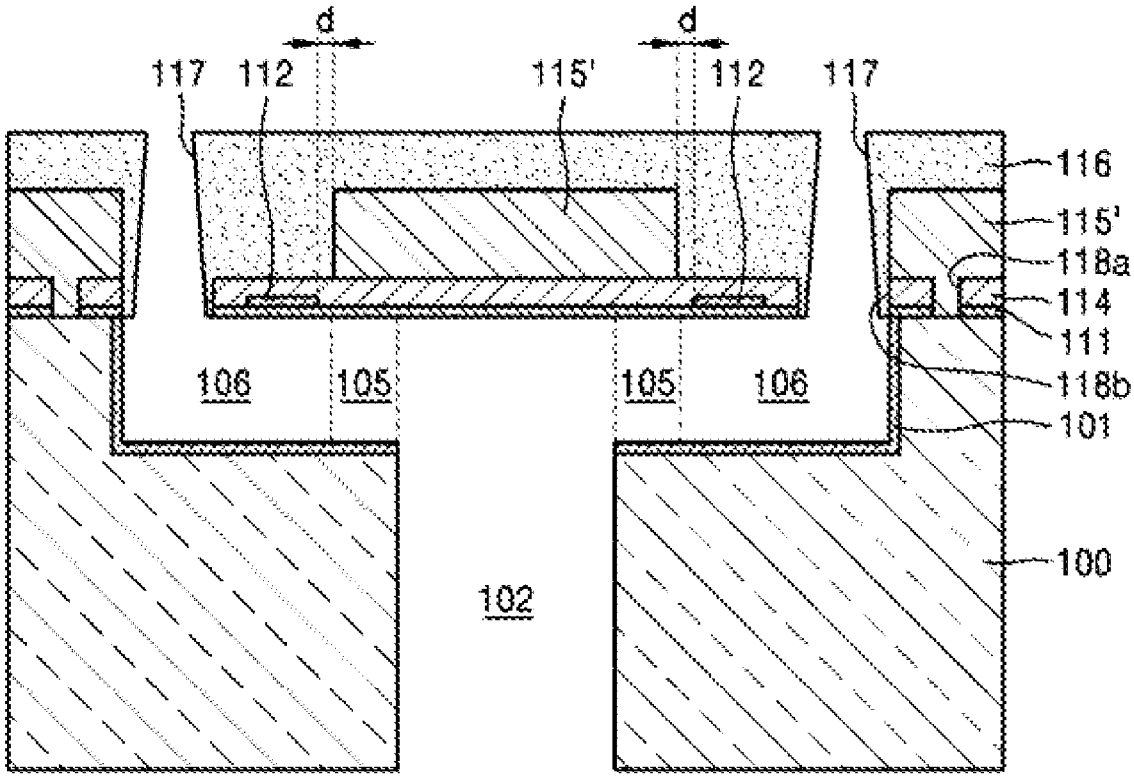
FIG. 6 is a sectional view illustrating an inkjet printhead according to another embodiment of the present general inventive concept.

A heat transfer layer 115 is formed with a predetermined thickness (t1) on a top surface of the second passivation layer 114. The heat transfer layer 115 contacts the top surface of the substrate 100 through the thermal plugs 118*a*. The heat transfer layer 115 can entirely cover the top surface of the second passivation layer 114. The heat transfer layer 115 may be formed of silver (Ag) that has a high thermal conductivity, and may have the thickness (t1) of about 5 μm or more. The heat transfer layer 115 rapidly dissipates heat generated from the heaters 112 to the substrate 100 through the thermal plugs 118*a*. Accordingly, the heat generated from the heaters 112 is effectively dissipated to the substrate 100 through the heat transfer layer 115 after the ejection of the ink, such that ink ejecting characteristics of the printhead are not degraded by the heat accumulating in an epoxy nozzle layer 116 (described below) and inadvertently heating the ink remaining in the ink chambers 106. As illustrated in FIGS. 4 and 5, the heat transfer layer 115 entirely covers the top surface of the second passivation layer 114, however, the heat transfer layer 115 can be formed to partially cover the top surface of the second passivation layer 114. For example, FIG. 6 illustrates an inkjet printhead according to another embodiment of the present general inventive concept. Referring to FIG. 6, a heat transfer layer 115' is spaced a predetermined distance (d) from a side of each of the heaters 112 and partially covers the top surface of the second passivation layer 114. The elements of the inkjet printhead of the embodiment of FIG. 6 function similarly to like numbered elements of the embodiment of FIGS. 3-5, and therefore detailed descriptions thereof are omitted.

The epoxy nozzle layer 116 is formed on the first and second passivation layers 111 and 114 and the heat transfer layer 115. The epoxy nozzle layer 116 defines the nozzles 117 in alignment with the nozzle via holes 118*b* to eject the ink therethrough. The epoxy nozzle layer 116 covers inner walls of the nozzle via holes 118*b* defined in the first and second passivation layers 111 and 114. Each of the nozzles 117 may have a tapered shape that becomes narrower toward an exit end to quickly stabilize a meniscus formed in a surface of the ink remaining in the ink chambers 106 after the ejection of the ink through the nozzles 117. The epoxy nozzle layer 116 may be formed of a photosensitive epoxy having a high formability. Accordingly, the nozzles 117 can be formed with a uniform shape and size. The epoxy nozzle layer 116 may have a relatively thick thickness (t2) of about 20 μm to 30 μm. Therefore, the nozzles 117 can be elongated sufficiently to increase directivity of ink droplets ejected through the nozzles 17. The epoxy nozzle layer 116 prevents the metallic heat transfer layer 115 from contacting the ink, such that corrosion of the heat transfer layer 115 by the ink can be prevented.

As described above, in the inkjet printhead of the embodiments of the present general inventive concept, the heat generated from the heaters 112 is rapidly dissipated to the substrate 100 through the heat transfer layer 115 after the ejection of the ink droplets, such that the ink ejecting characteristics of the inkjet printhead are not degraded. Furthermore, the nozzles 117 formed in the epoxy nozzle layer 116 have a relatively long length, such that the directivity of the ink droplets ejected through the nozzles 117 can be improved.

FIGS. 7A through 7I illustrate a method of manufacturing an inkjet printhead according to an embodiment of the present general inventive concept. Referring to FIGS. 3-5 and 7A-7I, the method of manufacturing the inkjet printhead according to this embodiment is described below.

Figure 7A:
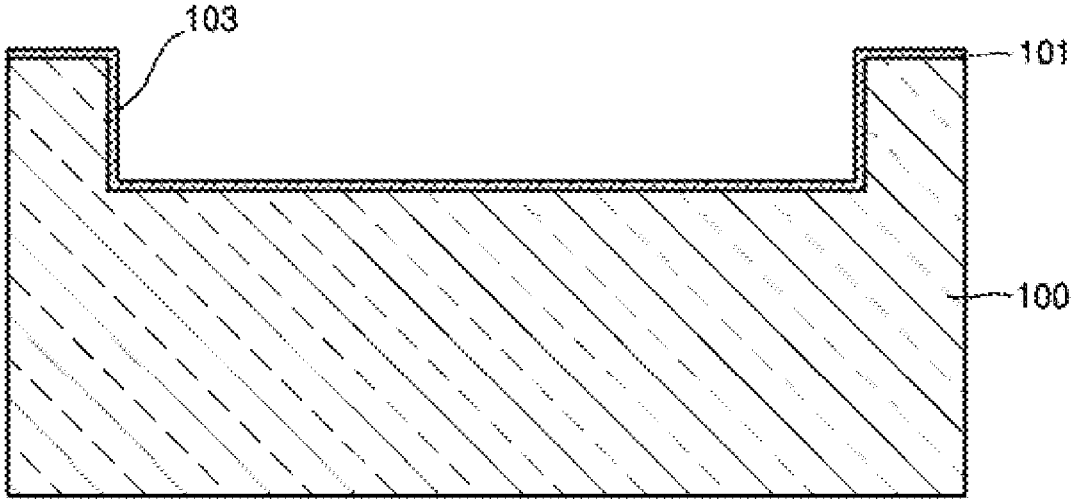
FIGS. 7A through 7I are views illustrating a method of manufacturing an inkjet printhead according to an embodiment of the present general inventive concept.

As illustrated in FIG. 7A, a trench 103, in which the ink chambers 106 and the restrictors 105 are to be defined, is formed in the top surface of the substrate 100 by etching the substrate 100 in a predetermined pattern. A silicon wafer can be used for the substrate 100. An etch mask (not shown) can be formed on the top surface of the substrate 100 to define a region to be etched, and a portion of the substrate 100 exposed through the etch mask is then etched to form the trench 103 with a predetermined shape. The etching may be carried out using a dry etch method, such as reactive ion etching (RIE). Since the trench 103 is formed by etching the top surface of the substrate 100, the trench 103 can have various shapes. Thus, desired shapes of the ink chambers 106 and the restrictors 105 can be obtained. After the trench 103 is formed, the etch mask is removed from the top surface of the substrate 100. Next, the top surface of the substrate 100 where the trench 103 is formed is oxidized to form the oxide layer 101 on the top surface of the substrate 100 including an inner surface of the trench 103. The oxide layer 101 may be formed of a silicon oxide.

Figure 7B:
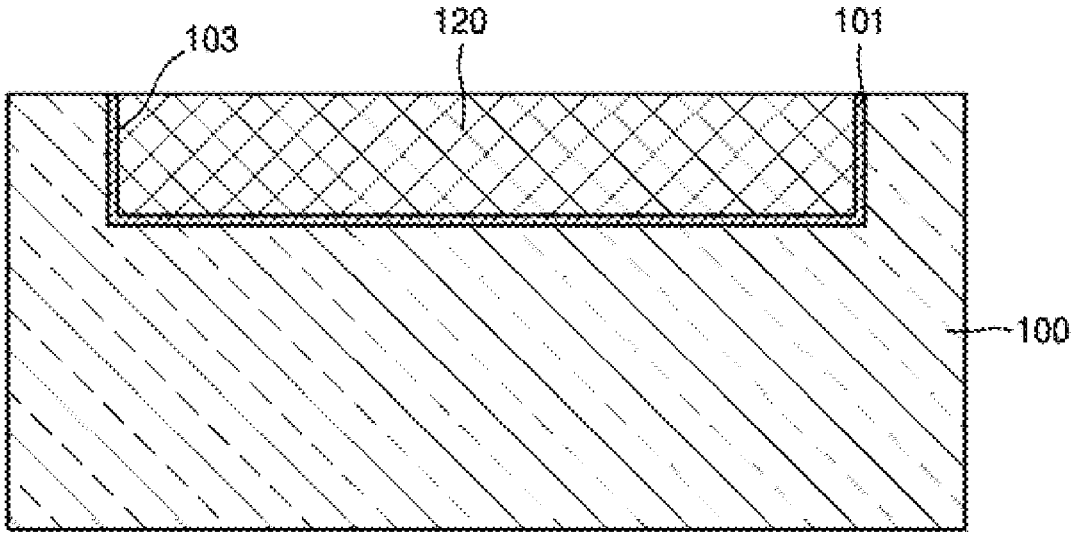

As illustrated in FIG. 7B, a sacrifice layer 120 formed of a predetermined material is filled in the trench 103. The sacrifice layer 120 may be formed of poly silicon. The poly silicon can be deposited on the oxide layer 101 of the substrate 100 using an epitaxial method to fill the trench 103, and the top surface of the poly silicon is then planarized through a chemical mechanical polishing (CMP) process. In the CMP process, an exposed portion of the oxide layer 103 is removed to expose the top surface of the substrate 100.

Figure 7C:
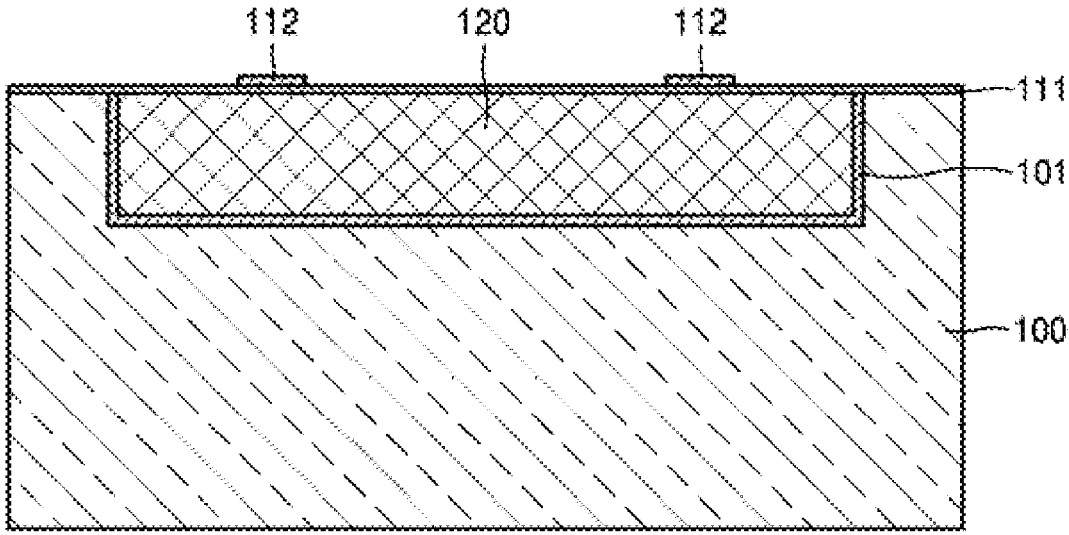
Figure 7D:
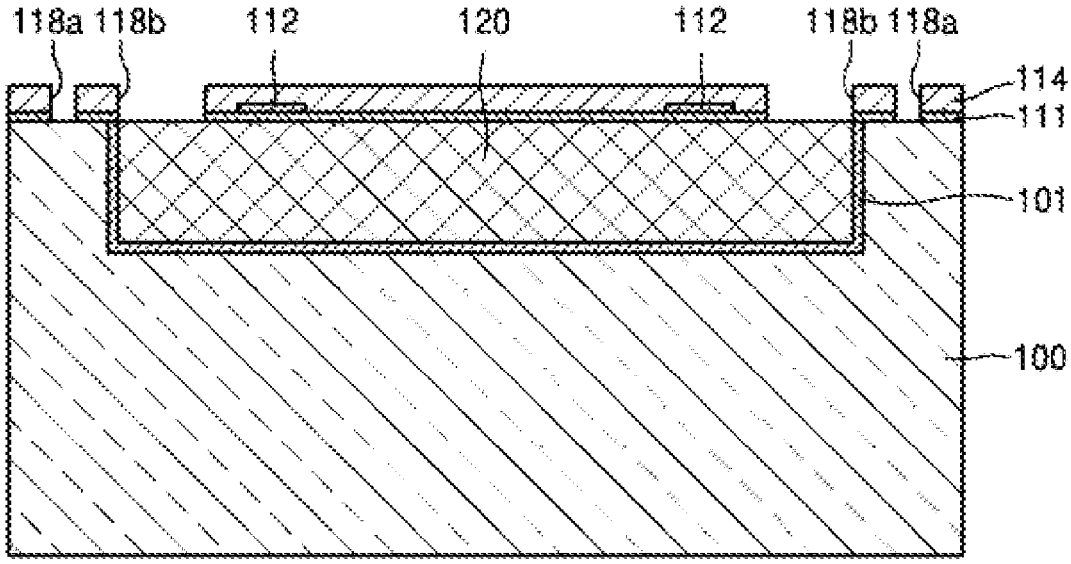

As illustrated in FIGS. 7C and 7D, the first and second passivation layers 111 and 114 are stacked on the top surfaces of the substrate 100 and the sacrifice layer 120, and the heaters 112 and the conductors 113 are formed between the first and second passivation layers 111 and 114. Referring to FIG. 7C, the first passivation layer 111 is formed on the top surfaces of the substrate 100 and the sacrifice layer 120. The first passivation layer 111 may be formed by depositing silicon oxide or silicon nitride on the top surfaces of the substrate 100 and the sacrifice layer 120. Next, the heaters 112 are formed on a top surface of the first passivation layer 111. The heaters 112 may be formed by depositing a resistive heating material, such as tantalum-aluminium alloy, tantalum nitride, titanium nitride, or tungsten silicide, on the top surface of the first passivation layer 111 to a predetermined thickness and patterning the deposited resistive heating material. The conductors 13 are then formed on top surfaces of the heaters 112. The conductors 113 may be formed by depositing metal having a high electric conductivity, such as aluminum (Al), aluminum alloy, gold (Au), or silver (Ag), on the top surfaces of the heaters 112 to a predetermined thickness and patterning the deposited metal.

Referring to FIG. 7D, the second passivation layer 114 is formed on the top surface of the first passivation layer 111 to cover the heaters 112 and the conductors 113. The second passivation layer 114 may be formed by depositing silicon oxide or silicon nitride on the first passivation layer 111. Next, the first and second passivation layers 111 and 114 are patterned through lithography and etching to form nozzle via holes 118*b* and thermal plugs 118*a* to expose the top surfaces of the sacrifice layer 120 and the substrate 100, respectively. The nozzle via holes 118*b* are formed at a position corresponding to where the nozzles 117 are to be formed, and the thermal plugs 118*a* are formed to expose the top surface of the substrate 100 at opposite sides of the substrate 100.

Figure 7E:
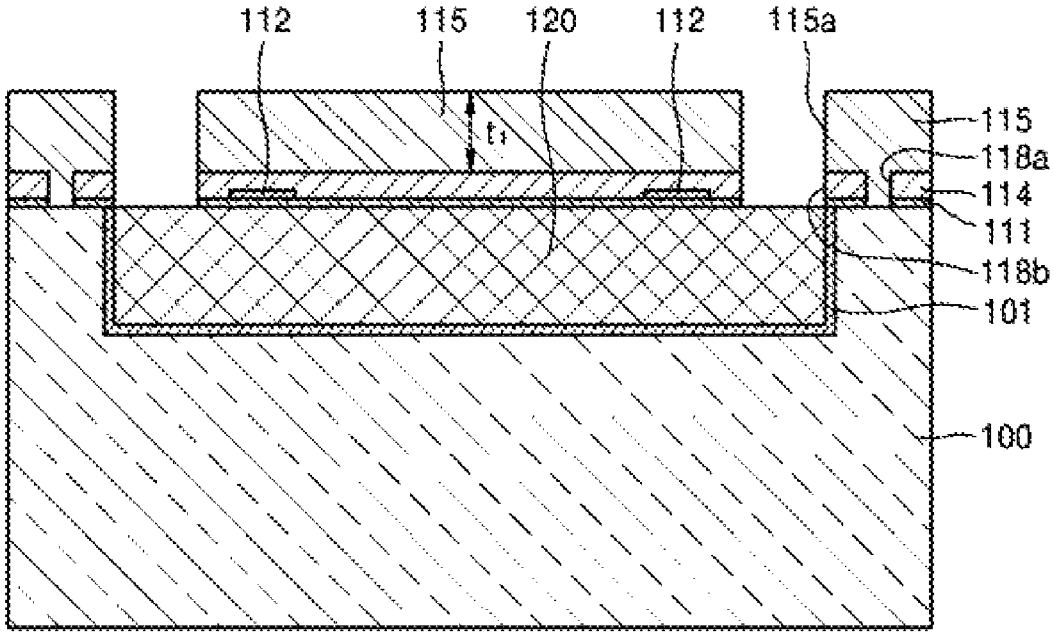

As illustrated in FIG. 7E, the heat transfer layer 115 is formed on the second passivation layer 114 to a predetermined thickness (t1) to fill the thermal plugs 118*a*. The predetermined thickness (t1) may be 5 μm or more. In order to form the heat transfer layer 15, a photosensitive Ag paste may be coated on the second passivation layer 114 to fill the nozzle via holes 118*b* and the thermal plugs 118*a*, and then the coated photosensitive Ag paste may be patterned through lithography. In the process of patterning the photosensitive Ag paste, through holes 115*a* are formed in the heat transfer layer 115 above the nozzle via holes 118*b* to communicate with the nozzle via holes 118*b* and expose the top surface of the sacrifice layer 120. As illustrated in FIG. 7E, the heat transfer layer 115 entirely covers the top surface of the second passivation layer 114. Alternatively, the heat transfer layer 115' of the embodiment of FIG. 6 can be formed on the second passivation layer 114 to partially cover the second passivation layer 114 and to be spaced a predetermined distance (d) from a side of each of the heaters 112, as illustrated in FIG. 6.

Figure 7F:
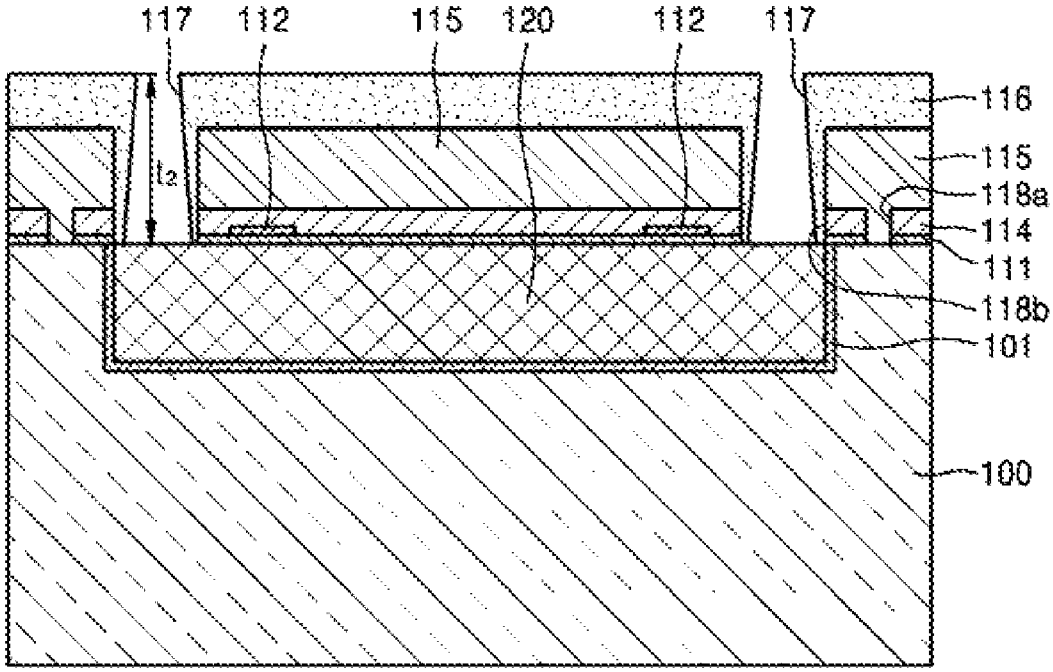

As illustrated in FIG. 7F, the epoxy nozzle layer 116 is formed to cover the first and second passivation layers 111 and 114 and the heat transfer layer 115. The epoxy nozzle layer 116 defines the nozzles 117 in alignment with the nozzle via holes 118*b* and the through holes 115*a* to expose the top surface of the sacrifice layer 120. The epoxy nozzle layer 116 may have a thickness (t2) of about 20 μm to 30 μm. In order to form the epoxy nozzle layer 116, a photosensitive epoxy may be coated on the first and second passivation layers 111 and 114 and the heat transfer layer 115 to a predetermined thickness to fill the nozzle via holes 118*b*, and the coated photosensitive epoxy may then be patterned through lithography. In the process of patterning the photosensitive epoxy, the nozzles 117 are formed to align with the nozzle via holes 118*b* and the through holes 115*a* to expose the top surface of the sacrifice layer 120. The nozzles 117 may be tapered toward an exit end thereof.

Figure 7G:
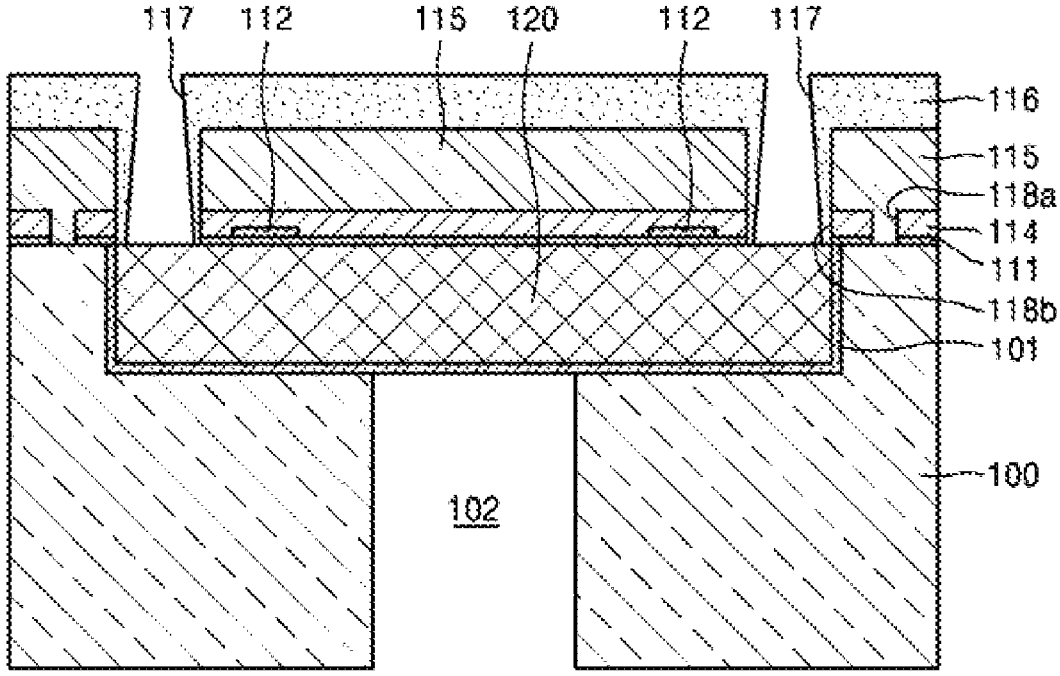

As illustrated in FIG. 7G the ink feedhole 102 is formed by etching a bottom surface of the substrate 100. In the process of etching the bottom surface of the substrate 100, the oxide layer 101 formed on the bottom of the trench 103 is exposed through the ink feedhole 102. To form the ink feedhole 102, an etch mask (not shown) may be formed on the bottom surface of the substrate 100 to define a region to be etched, and the substrate 100 exposed through the etch mask may then be dry etched or wet etched until the oxide layer 101 is exposed.

Figure 7H:
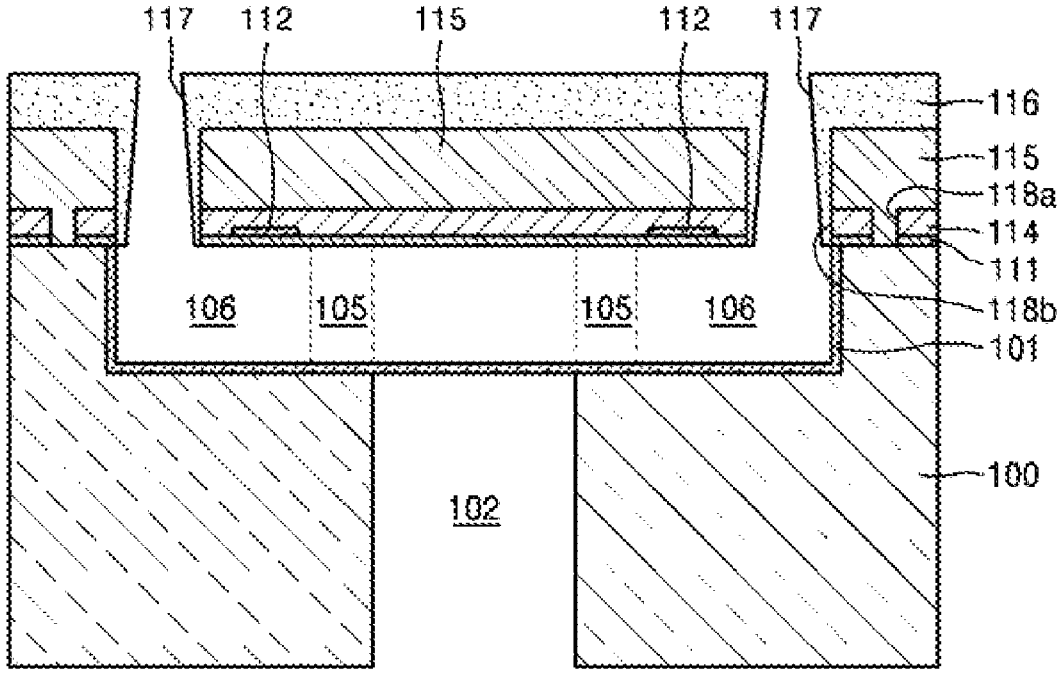

As illustrated in FIG. 7H, the sacrifice layer 120 exposed through the nozzles 117 is removed through etching to form the ink chambers 106 and the restrictors 105. Thus, the ink chambers 106 and the restrictors 105 are formed parallel to the top surface of the substrate 100 on the same plane as each other. The ink chambers 106 and the restrictors 105 may be formed by using etch gas, such as XeF2 gas or BrF3, to dry etch the sacrifice layer 120 exposed through the nozzles 117. In the process of etching the sacrifice layer 120, the oxide layer 101 formed on the inner wall of the trench 103 can function as an etch stop layer.

Figure 7I:
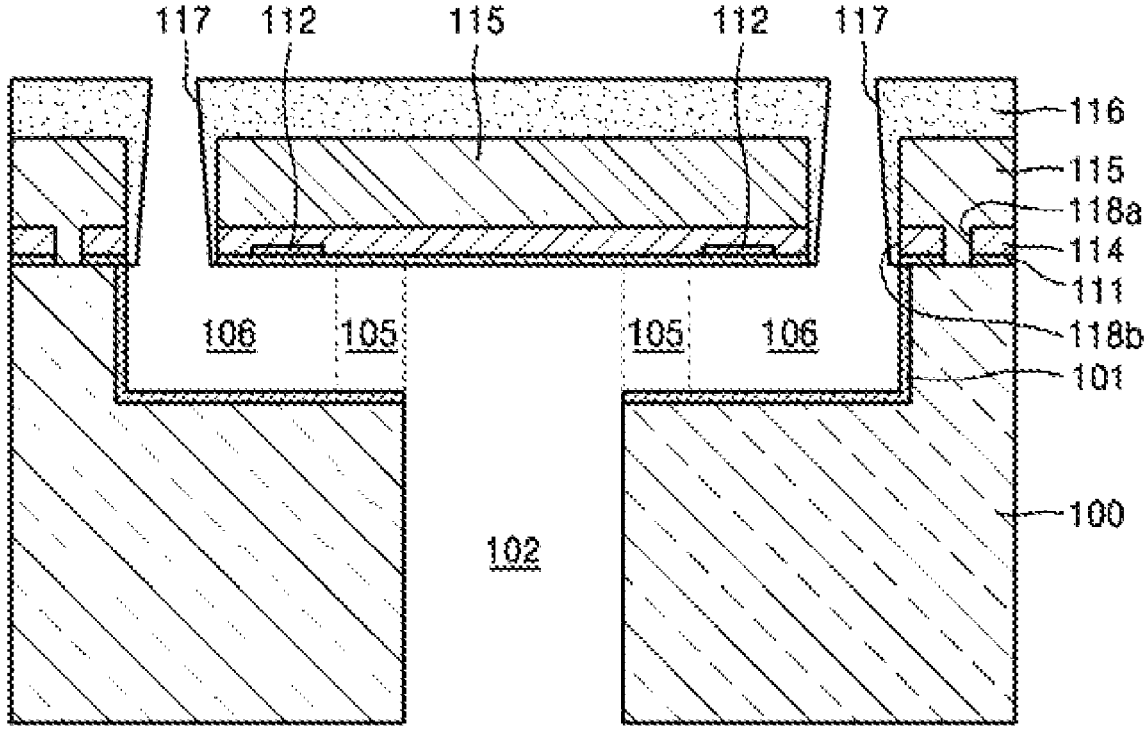

As illustrated in FIG. 7I, a portion of the oxide layer 101 located between the restrictors 105 and the ink feedhole 102 is removed through dry etching, thereby completing the manufacturing method of the inkjet printhead according to this embodiment of the present general inventive concept.

As described above, in an inkjet printhead according to an embodiment of the present general inventive concept, after ink is ejected, heat generated from heaters is rapidly dissipated to a substrate through a heat transfer layer formed of a high thermal conductive metal. Accordingly, ink ejecting characteristics of the inkjet printhead are not degraded by the generated heat.

Furthermore, in an inkjet printhead according to an embodiment of the present general inventive concept, nozzles are defined in an epoxy nozzle layer formed of a photosensitive epoxy that has a good formability, such that the nozzles can be formed with a uniform shape and size.

Also, the epoxy nozzle layer has a relatively thick thickness, such that the nozzles can be elongated sufficiently Therefore, directivity of ink droplets ejected through the nozzles can be improved.

Moreover, the epoxy nozzle layer prevents a metallic heat transfer layer from contacting the ink, thereby preventing the heat transfer layer from corrosion by the ink.

As described above, an inkjet printhead according to an embodiment of the present general inventive concept can be used for an array printhead of a line printing type inkjet printer, as well as an inkjet printhead of a shuttle type inkjet printer. Since a plurality of inkjet printheads are arranged in the array printhead, heat generated from heaters is considerably large. Accordingly, an inkjet printhead according to an embodiment of the present general inventive concept can be usefully applied to the array printhead.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents. For example, when a layer is referred to as being "on" another layer or substrate, it can be directly on the other layer or substrate, or intervening layers may also be present. Further, each element of the inkjet printhead of the embodiments of the present general inventive concept can be formed of material different from those described and illustrated, and the above-described stacking and forming methods of materials are exemplary. Accordingly, other various stacking and forming methods can be used. Furthermore, in a method of manufacturing an inkjet printhead according to an embodiment of the present general inventive concept, the order of operations can be changed.

What is claimed is:

1. An inkjet printhead comprising:

a substrate including an ink chamber formed in a top surface thereof to contain ink to be ejected, an ink feedhole formed in a bottom surface thereof to supply the ink to the ink chamber, and a restrictor formed between the ink chamber and the ink feedhole to connect the ink chamber and the ink feedhole;

a plurality of passivation layers formed on the substrate;

a heater and a conductor that are formed between the passivation layers, the heater disposed above the ink chamber, and the conductor applying a current to the heater;

a heat transfer layer formed on the passivation layers in a predetermined shape; and an epoxy nozzle layer formed to cover the passivation layers and the heat transfer layer, the epoxy nozzle layer being formed with a nozzle connected to the ink chamber.

2. The inkjet printhead of claim 1, wherein the passivation layers define a thermal plug therethrough to expose the top surface of the substrate, and the heat transfer layer contacts the substrate through the thermal plug.

3. The inkjet printhead of claim 2, wherein the passivation layers define a nozzle via hole therethrough in alignment with the nozzle, and the epoxy nozzle layer is formed to cover an inner wall of the nozzle via hole.

4. The inkjet printhead of claim 2, wherein the heat transfer layer is formed on an entire top surface of the passivation layers.

5. The inkjet printhead of claim 2, wherein the heat transfer layer is formed on a top surface of the passivation layers in a region located a predetermined distance from a side of the heater.

6. The inkjet printhead of claim 2, wherein the heat transfer layer is formed of silver (Ag).

7. The inkjet printhead of claim 2, wherein the heat transfer layer has a thickness of 5 μm or more.

8. The inkjet printhead of claim 2, wherein the epoxy nozzle layer is formed of a photosensitive epoxy.

9. The inkjet printhead of claim 2, wherein the epoxy nozzle layer has a thickness of 20 μm to 30 μm.

10. The inkjet printhead of claim 2, wherein the passivation layers include a first passivation layer and a second passivation layer that are sequentially stacked on the substrate, the heater is formed between the first and second passivation layers, and the conductor is formed between the heater and the second passivation layer.

11. The inkjet printhead of claim 10, wherein the first and second passivation layers are formed of silicon oxide or silicon nitride.

12. The inkjet printhead of claim 2, wherein the restrictor is formed on the same plane as the ink chamber.

13. The inkjet printhead of claim 12, wherein the ink chamber and the restrictor include inner walls formed with oxide layers.

14. The inkjet printhead of claim 2, wherein the ink chamber and the shaped side section that becomes narrower toward an exit end of the nozzle.

15. An inkjet printhead, comprising:

a substrate having an ink chamber to contain ink;

a heater to heat the ink contained in the ink chamber;

one or more passivation layers adjacent to the heater to protect the heater; and a heat transfer layer to contact a portion of the one or more passivation layers and a surface of the substrate to dissipate heat generated by the heater from the one or more passivation layers to the substrate.

16. The inkjet printhead of claim 15, wherein the one or more passivation layers comprise a first passivation layer disposed on the substrate between the heater and the ink chamber, and a second passivation layer disposed on the first passivation layer to cover the heater.

17. The inkjet printhead of claim 16, wherein then heat transfer layer is disposed on the second passivation layer.

18. The inkjet printhead of claim 17, further comprising:

one or more thermal plugs defined through the first and second passivation layers, wherein the heat transfer layer is formed through the thermal plugs to contact the surface of the substrate.

19. The inkjet printhead of claim 15, wherein the heat transfer layer comprises a metal having a high thermal conductivity.

20. An inkjet printhead, comprising:

a substrate having an ink chamber to store ink;

a heater to heat the ink in the ink chamber;

a nozzle layer having nozzles to eject droplets of the ink from the ink chamber due to heat generated by the heater;

one or more passivation layers to separate the heater from the substrate and the nozzle layer, and formed with a thermal plug to expose a surface of the substrate therethrough; and a heat transfer layer formed between the one or more passivation layers and the nozzle layer and in the thermal plug to prevent the heat generated by the heater from accumulating in the nozzle layer by dissipating the heat to the surface of the substrate.

* * * * *

UNITED STATES PATENT AND TRADEMARK OFFICE

CERTIFICATE OF CORRECTION

PATENT NO. : 7,607,759 B2
APPLICATION NO. : 11/379291
DATED : October 27, 2009
INVENTOR(S) : Min et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 611 days.

Signed and Sealed this

Twelfth Day of October, 2010

David J. Kappos

David J. Kappos
*Director of the United States Patent and Trademark Office*